US007288017B2

(12) United States Patent
Mukaida

(10) Patent No.: US 7,288,017 B2
(45) Date of Patent: Oct. 30, 2007

(54) TWO-WHEELED TOY VEHICLE BY RADIO CONTROL

(75) Inventor: Kenji Mukaida, Tokyo (JP)

(73) Assignee: Nikko Co., Ltd., Tokyo (JP)

( * ) Notice: Subject to any disclaimer, the term of this patent is extended or adjusted under 35 U.S.C. 154(b) by 315 days.

(21) Appl. No.: 10/538,742

(22) PCT Filed: Dec. 20, 2002

(86) PCT No.: PCT/JP02/13392

§ 371 (c)(1),
(2), (4) Date: Jun. 14, 2005

(87) PCT Pub. No.: WO2004/056436

PCT Pub. Date: Jul. 8, 2004

(65) Prior Publication Data

US 2006/0154564 A1 Jul. 13, 2006

(51) Int. Cl.
*A63H 17/16* (2006.01)
*A63H 17/25* (2006.01)

(52) U.S. Cl. ..... 446/440; 446/275; 446/457

(58) Field of Classification Search ..... 446/269, 446/288, 272, 273, 247, 275, 276, 279, 280, 446/287, 437, 440, 454, 317, 448, 451, 456, 446/458, 460

See application file for complete search history.

(56) References Cited

U.S. PATENT DOCUMENTS 2,645,056 A * 7/1953 Mangold ..... 446/279
3,785,086 A 1/1974 Escobedo
4,563,164 A * 1/1986 Tao ..... 446/440
4,966,569 A 10/1990 Asano
6,729,933 B2 * 5/2004 Hoeting et al. ..... 446/275

FOREIGN PATENT DOCUMENTS

| | | |
|---|---|---|
| GB | 2 217 217 | 10/1989 |
| JP | 49-73600 | 6/1974 |
| JP | 57-64076 | 4/1982 |
| JP | 1-254191 | 10/1989 |
| JP | 2-149292 | 12/1990 |
| JP | 9-504716 | 5/1997 |
| WO | WO95/11069 | 4/1995 |

* cited by examiner

*Primary Examiner*—Nini F. Legesse
(74) *Attorney, Agent, or Firm*—Young & Thompson

(57) ABSTRACT

A two-wheeled toy vehicle by radio control having a supporting member of a front wheel mounted on a vehicle body so as to control freely in steering angle and a rider-like doll mounted on an upper portion of the vehicle body, the doll response to the radio controlled steering operation, effecting parallel displacement vertically to traveling direction and horizontally to the vehicle body, the steering operation being effected by slanting the supporting member of the front wheel in accordance with displacement of the toy's gravity center caused by the parallel displacement of the doll. The supporting member of the front wheel includes a front fork joint provided with a connecting portion combined to the vehicle body and a long cylindrical member provided with an oval like opening portion at its upper part with opposite ends being jointed with a specific angle to the connecting portion.

10 Claims, 5 Drawing Sheets

TWO-WHEELED TOY VEHICLE BY RADIO CONTROL

TECHNICAL FIELD OF THE INVENTION

The present invention relates to a two-wheeled toy vehicle by radio control, specifically to the vehicle capable of cornering operation smoothly and stably by the technique similar to traveling in the full-scaled vehicle.

BACKGROUND OF THE INVENTION

The two wheeled toy vehicle generally demands much higher control technique in terms of requiring to traveling stably by maintaining balance to the horizontal direction, compared with a four-wheeled toy vehicle. Particularly, in the cornering operation, it is difficult to steer stably because of demanding a horizontal balance different from a straight line travel.

For instance, in the U.S. Pat. No. 3,785,086 the self-steering bicycle-type toy vehicle comprises an upstanding first wheel, a rotating axis, an elongated frame with a guide wheel, a counter balance suspended so as to swing at the first wheel below the level of the center of the first wheel, and a link means.

Also, it is disclosed in the Japanese laid-open patent publication No. 1-254191 that a battery box unit is mounted swingablly on the lower portion of the vehicle body and the steering operation is controlled in a manner that the battery box unit is slanted from side to side to the direction of traveling under radio control, and that a supporting member of the front wheel is pivotally and freely in the steering angle connected to the steering portion mounted on the vehicle body, and the supporting member is controlled to freely slant from side to side to the direction of traveling to a pivotal axis of a pivotal portion, wherein there is provided a bearing in the steering bracket fitted on a front end portion of the vehicle body. A connecting pin is inserted into the connecting portion of the bearing, which cross sectional shape is formed to be increased in diameter to the downward direction and includes a longitudinal hole with larger diameter in the right and left directions.

Further there is disclosed in the Japanese laid-open utility model publication No. 2-149292 by the same applicant as the above Japanese laid-open patent publication No. 1-254191, wherein a balance weight is arranged so as to swing to the right and left directions, the balance weight embedded inside the loaded article like dolls and other.

Besides, it is disclosed in the national publication of translated version No. 9-504716 that a rider-like doll including a swing support and a battery are brought into weight shift condition by rotation given from a servo unit, which causes to turn the motor cycle toy mounting the doll and battery thereon.

However, any inventions disclosed in the publications mentioned above relate to the type of weight displacement in which not only the rider like doll, but also the battery or the counter balance move so as to cause weight displacement, and therefore those inventions do not disclose the two wheeled toy vehicle capable of cornering operation similar to the two wheeled motor vehicle, the cornering operation so called "hang on", the steering techniques of the two-wheeled motor vehicle, realized by parallel displacement of the doll.

Namely, in order to effectuate self-steering by slanting or tilting the two-wheeled toy vehicle realized by weight displacement, it is necessary to enhance the sharpness of steering, that is, responsiveness to weight displacement, while such enhancement of the responsiveness inhibits traveling in the straight line.

Accordingly, it is an object of the present invention to provide a two-wheeled toy vehicle capable of cornering operation and traveling in the straight line smoothly and stably, making the doll to act bodily motion closer to the actual rider.

DISCLOSURE OF THE INVENTION

To achieve the object, the present invention according to claim 1 provides a two-wheeled toy vehicle by radio control having a supporting member of a front wheel mounted on a vehicle body so as to control freely in steering angle and a rider-like doll mounted on an upper portion of the vehicle body so as to swing, the doll, responsive to the radio controlled steering operation, effecting parallel displacement vertically to traveling direction and horizontally to the vehicle body, the steering operation being effected by slanting the supporting member of the front wheel in accordance with displacement of the toy's gravity center caused by the parallel displacement of the doll, wherein the supporting member of the front wheel comprises a front fork joint provided with a connecting portion combined to the vehicle body and a tube provided with an opening portion at its upper part wherein opposite ends are jointed with a specific angle to the connecting portion, and the horizontal direction corresponds to a major axis, and a front fork provided with a connecting pin inserted into the opening portion and fixed there so as to rotate and swing, a bracket from the upper portion of which the connecting pin protrudes and two shaft members disposed underneath the bracket holding a tire between the two shaft members.

Also, the present invention according to claim 2 provides the two-wheeled toy vehicle by radio control characterized in that a diameter of the opening portion at the bottom of the tube is smaller than that of the opening portion at the upper part of the tube.

The present invention according to claim 3 provides the two-wheeled toy vehicle by radio control characterized in that the opening portion is oval.

The present invention according to claim 4 provides the two-wheeled toy vehicle by radio control characterized in that the tube is a long cylindrical member.

The present invention according to claim 5 provides the two-wheeled toy vehicle by radio control characterized in that the opening portion at the bottom of the tube is a perfect circle.

The present invention according to claim 6 provides the two-wheeled toy vehicle by radio control characterized in that the bottom of the long cylindrical member has a convex and round face in the major axis direction, and a concave and round face in the minor axis direction.

The present invention according to claim 7 provides the two-wheeled toy vehicle by radio control characterized in that the front fork comprises respective shaft members upstanding at the upper part surface of the bracket so as to fix a fork stopper jointed with a steering handle, and respective protrusion for latch protruding from the surface of each shaft member in the direction of traveling to latch the long cylindrical member.

The present invention according to claim 8 provides the two-wheeled toy vehicle by radio control characterized in that the front fork further comprises another shaft members protruding from the under part of the bracket wherein each shaft member is at a specific angle with the respective shaft member upstanding at the upper part surface of the bracket.

The present invention according to claim 9 provides the two-wheeled toy vehicle by radio control characterized in that the front fork further comprises another shaft members protruding from the under part of the bracket wherein each shaft member is at a specific angle with the respective shaft member upstanding at the upper part surface of the bracket.

DETAILED DESCRIPTION OF THE PREFERRED EMBODIMENTS

Other objects, advantages and features will be apparent from the following description of the preferred embodiments of the present invention referring to the accompanying drawings.

Figure 1:
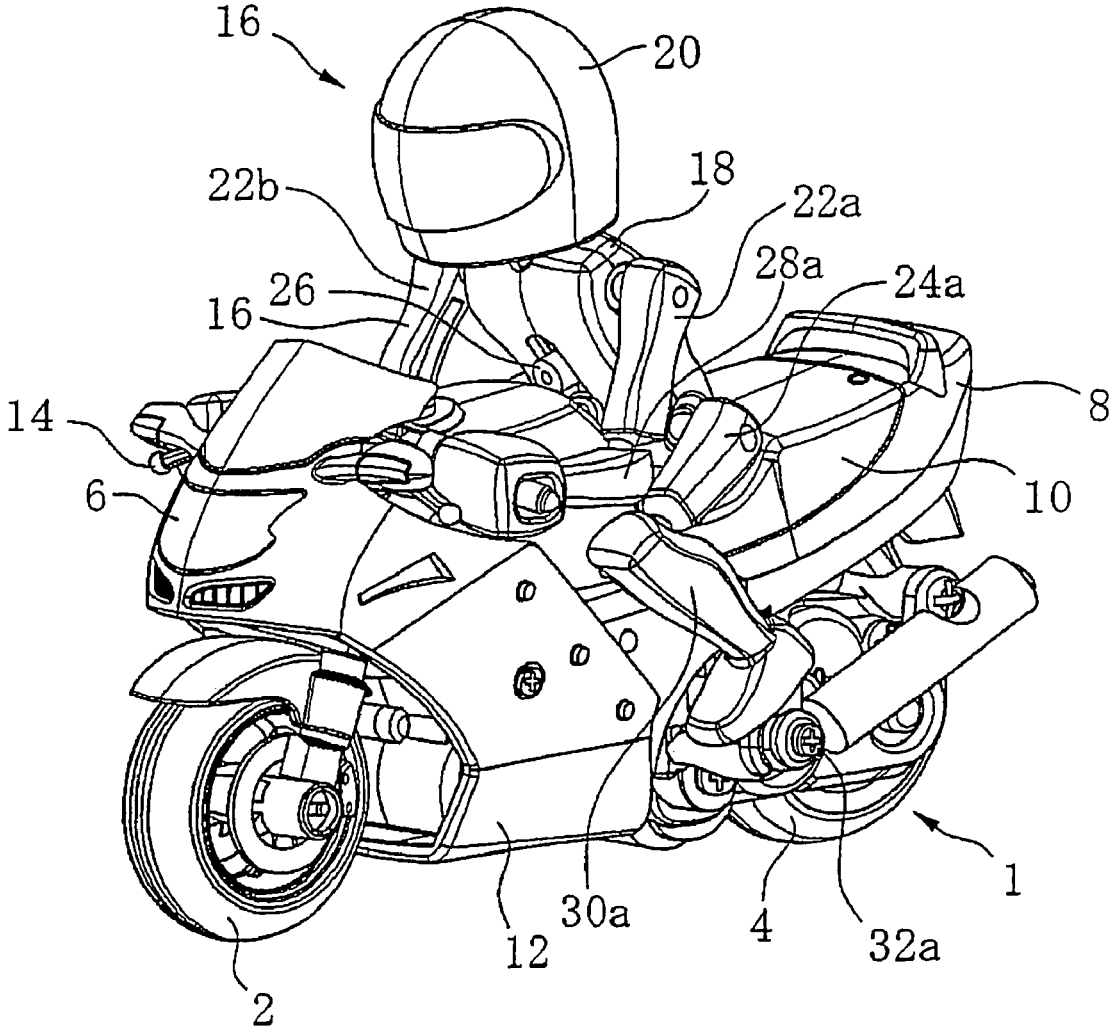
FIG. 1 is an oblique projected drawing illustrating an embodiment of a two-wheeled toy vehicle by radio control according to the present invention.

FIG. 1 is an oblique projected drawing illustrating an embodiment of a two-wheeled toy vehicle by radio control according to the present invention. In FIG. 1, numeral 2 is a front wheel, numeral 4 is a rear wheel, numeral 6 is a front cowl, numeral 8 is a rear cowl, numeral 10 is a seat, numeral 12 is a chassis cover, numeral 14 is a handle for steering and numeral 16 is a doll.

The upper body 18 of the doll 16 is disposed on the seat 10. A head region 20 is fixed to the upper body 18. Each regio brachialis 22*a* and 22*b* is mounted pivotally on the opposite upper sides of the upper body 18. Each regio femoralis 24*a* and 24*b* is mounted pivotally on the opposite under sides of the upper body 18. In addition, the head region 20 may be mounted pivotally on the upper body 18, but it is preferable to allow the head region 20 to slightly move or to fix to the upper body 18 from the view points of enhancement stably and design.

There is provided with an elongated slot 26 in the upper body 18 which is bored at the center region to the vertical direction. A pin fitted on a lever connected to a servo unit (not shown) perforates the elongated slot 26. As the servo unit rotates, the lever moves and then the pin moves in the elongated slot 26, thereby as a whole causing the upper body 18 to effect the parallel displacement on the seat 10.

The head region 20 is necessary to have enough weight to effect the weight displacement. However the weight is also defined to be able to get back from the weight displacement at the time of turning head region.

The regio brachialis 22*a* and 22*b* provide pivotally with front arms 28*a* and 28*b* at respective end portions. Connected with the end of each front arm 28*a* and 28*b* there is provided with a hand portion in which a hole is formed, and a handle penetrates through the hole.

The regio femoralis 24*a* and 24*b* provide pivotally with lower legs (regio cruralis) 30*a* and 30*b* at respective end portions. Connected with the end of each lower leg 30*a* and 30*b* there is provided with a foot ankle assembly which is fastened on steps 32*a* and 32*b* disposed protruding forwards the rear wheel 4.

A receiver, the servo unit, and its drive means (each of which is not shown in FIG. 1) necessary for radio controlled operation are arranged inside the rear cowl 8 and the chassis cover 12. Also, a steering section is arranged inside the front cowl 6 (not shown in FIG. 1).

Figure 2:
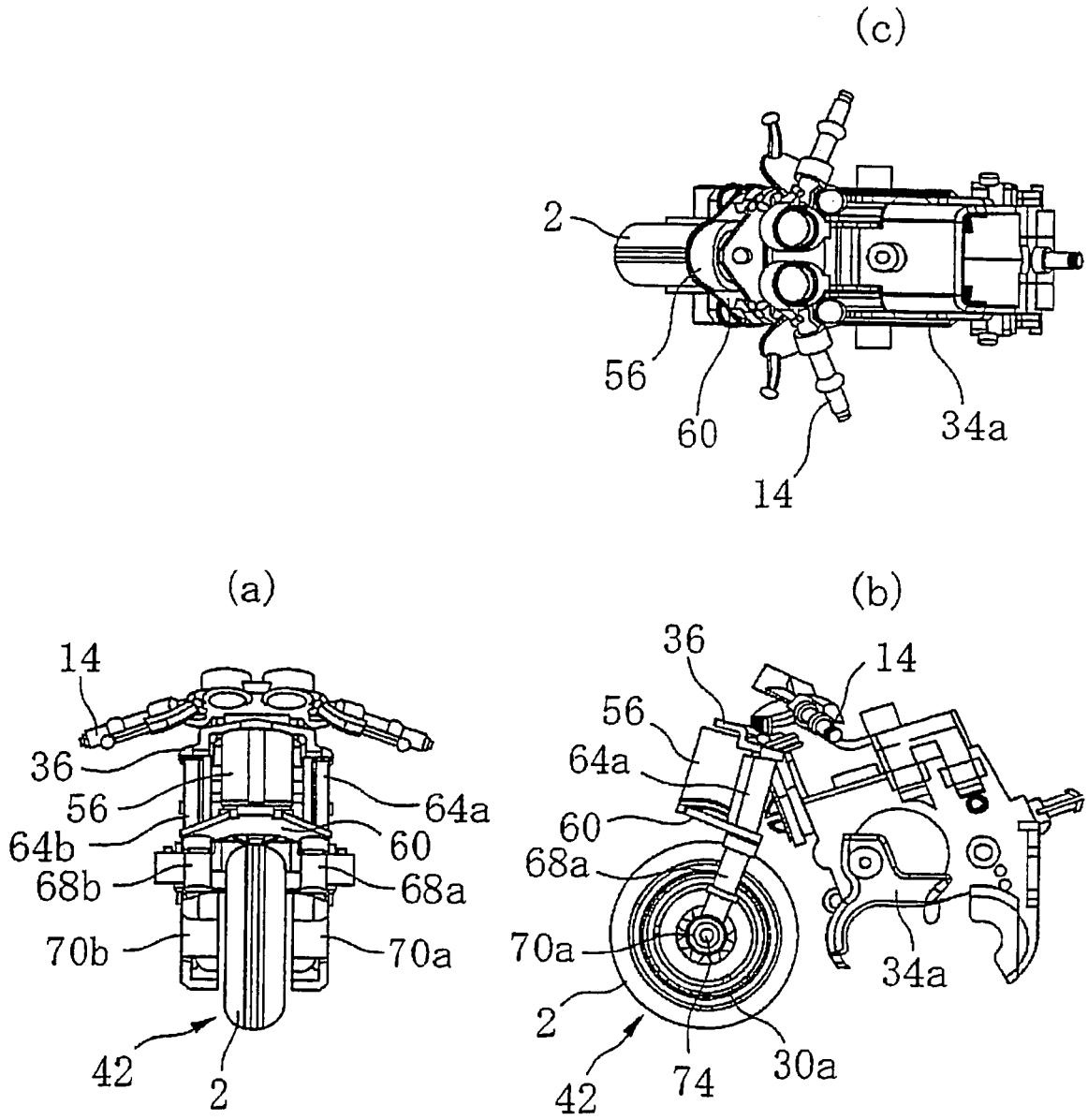
FIG. 2 is three side drawings illustrating the front of the embodiment of the two-wheeled toy vehicle by radio control according to the present invention wherein (a) is a front elevation view, (b) is a side elevation view and (c) is a top view.
Figure 3:
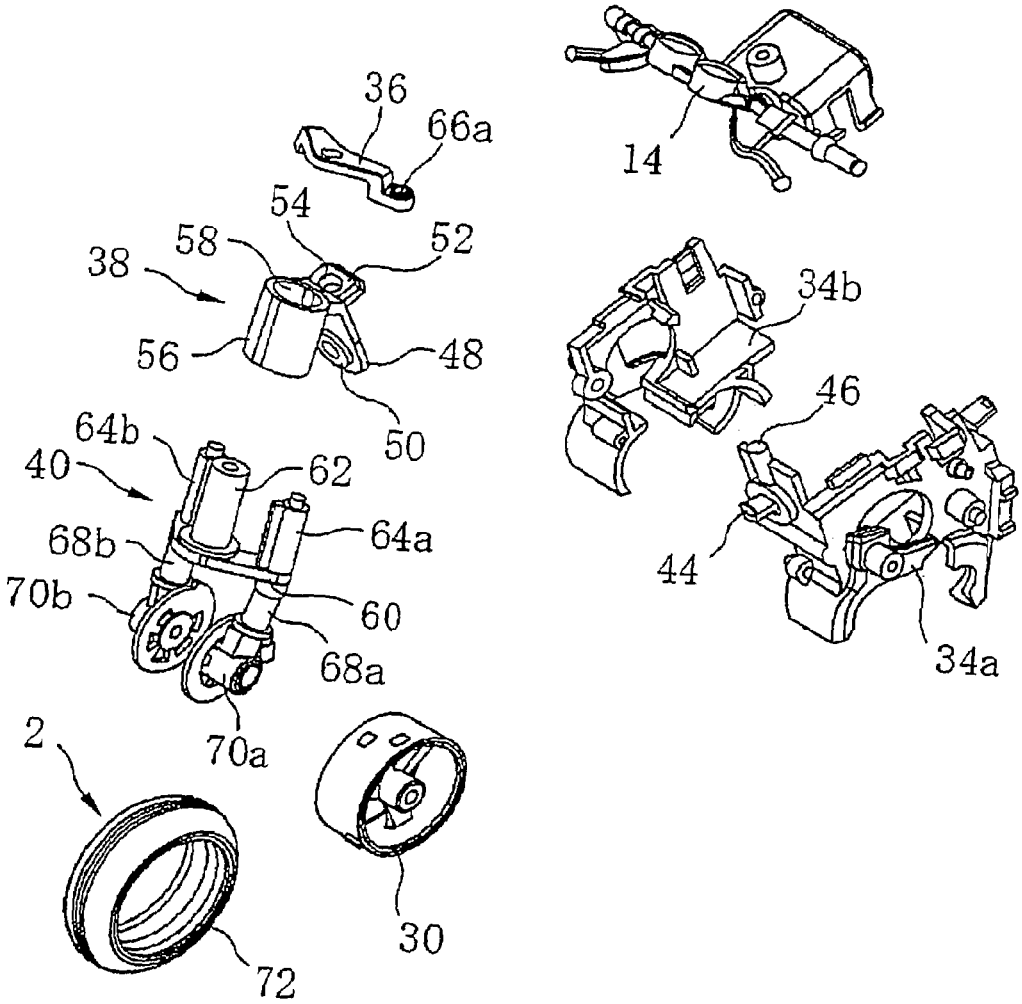
FIG. 3 is assembling drawings illustrating the front of the embodiment of the two-wheeled toy vehicle by radio control according to the present invention.

Next, a front area of the embodiment of the two-wheeled toy vehicle by radio control 1 according to the present invention will be explained referring to FIGS. 2 and 3.

The front area comprises chassis 34*a* and 34*b*, a supporting member of the front wheel. The supporting member of the front wheel comprises a handle 14, a fork stopper 36, a front fork joint 38, a front fork 40 and a wheel 42.

The chassis 34*a* and chassis 34*b* are combined at each edge and form a side surface of the vehicle toy. In the upper portion of the vehicle toy the handle 14 is connected with the upper portion and forms the chassis. In the side surface directed to the traveling direction of the chassis there is provided with a protrusion for latching 44, and there is provided with a protrusion 46 vertically and upwardly. The protrusion for latching 44 is connected through a hole 50 which opens at the end of a vertical joint plate 48 as a component part of the front fork joint 38. On the contrary, the protrusion 46 is connected through a hole 54 which opens at a horizontal joint plate 52 jointed to the vertical joint plate 48 of the front fork joint 38 vertically and horizontally.

Further the front fork joint 38 provides with a long cylindrical member 56 whose the inside forms an oval-like opening portion 58 and the long cylindrical member 56 forms juncture with the vertical joint plate 48 at a specific angle. A connecting pin 62 is inserted rotatably into the opening portion 58, which stands at the center portion of a bracket 60 as a component part of the front fork 40.

The front fork 40 provides with the connecting pin 62 upstanding upwardly at the center portion of the bracket 60, and shaft members 64*a* and 64*b* upstanding upwardly at the opposite ends of the bracket 60, respectively.

The fork stopper 36 has through-holes 66*a* and 66*b* at the opposite ends. The shaft members 64*a* and 64*b* are inserted in the through-holes 66*a* and 66*b* respectively, and the fork stopper 36 is fixed by being latched at the shoulder of the connecting pin 62.

The front fork 40 further provides with another shaft members 68*a* and 68*b* protruded downwards at the opposite ends of the bracket 60. There are provided with bearing units 70*a* and 70*b* for the front wheel 2 at the top portion of the shaft members 68*a* and 68*b*. A wheel 30 equipped with a tire 72 is fixed rotatably between the bearing units 70*a* and 70*b* after inserting an axle in the wheel center.

Next, the front fork joint 38 and the front fork 40 of the embodiment of the two-wheeled toy vehicle by radio control 1 according to the present invention will be explained in detail referring to FIGS. 4 and 5.

Figure 4:
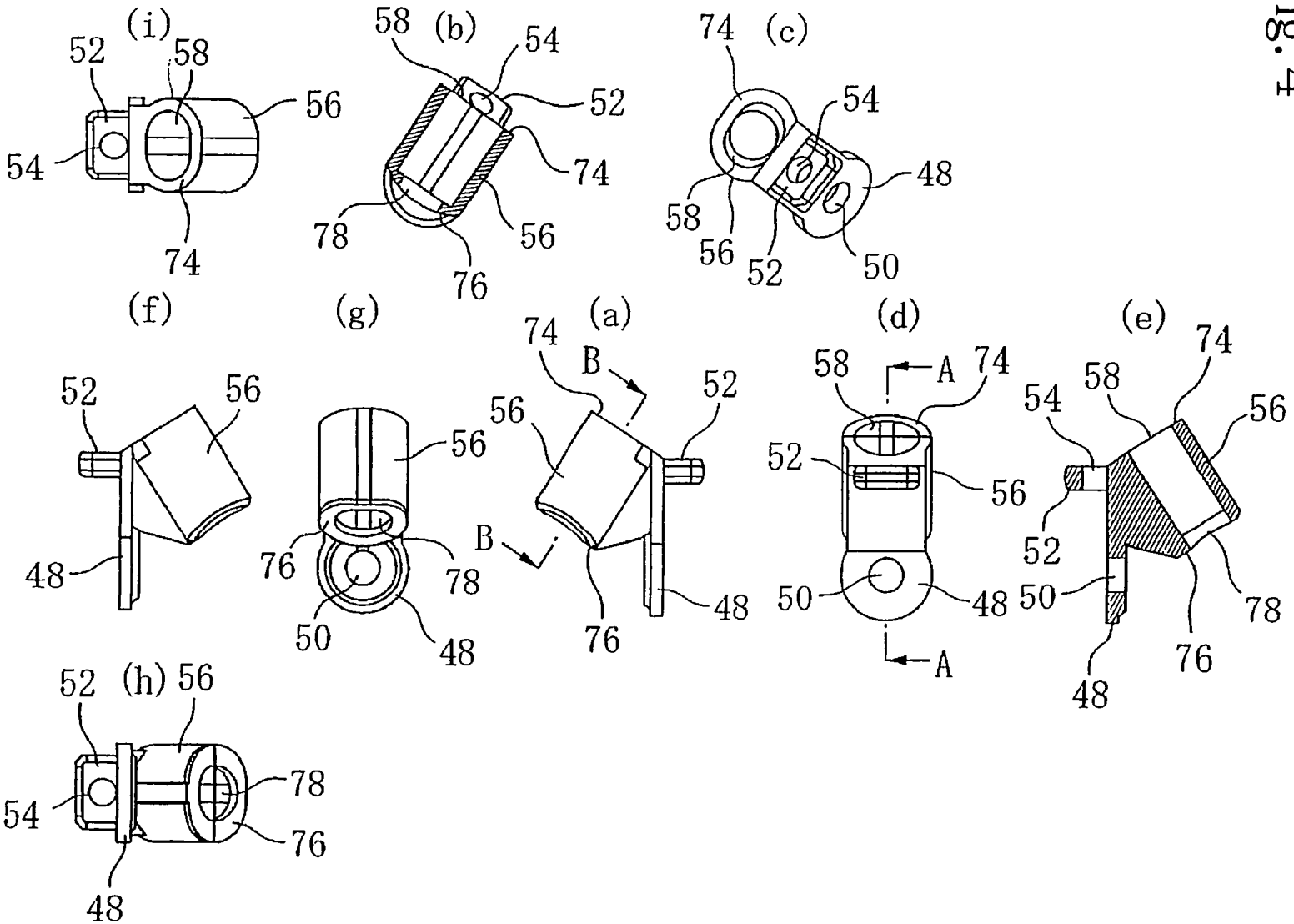
FIG. 4 is nine side drawings illustrating the front of a front fork joint portion of the embodiment of the two-wheeled toy vehicle by radio control according to the present invention wherein (a) is a side elevation view, (b) is a front slope view, (c) is a rear slope view, (d) is a rear elevation view, (e) is a cross sectional view taken along A-A line, (f) is a side elevation view, (g) is a front elevation view, (h) is a bottom plan view and (i) is a top view.

In the front fork joint 38, an upper surface opening portion 58 at an upper surface 74 is formed to be oval as shown in FIG. 4 (i). On the contrary, as shown in FIG. 4 (g), an under surface opening portion 78 at an under surface 76 of the long cylindrical member 56 is formed to be almost a perfect circle or a perfect circle which oblateness is nearly 1. As shown in FIG. 4 (b), which is the cross-sectional view taken along lines B-B of FIG. 4 (a), the under surface opening portion 78 is bored by the same internal diameter to the bottom surface, and the bored portion is formed to be a perfect circle which diameter is smaller than that of the upper portion within the opening portion. Also, the bottom surface is formed with a convex in respect to the center of the circle and round surface, and with the distance between the opposite ends in the horizontal direction, namely in the directions of right and left in respect to the traveling direction, to be relatively long.

By making the bottom surface to be convex, the front fork joint 38 can turn smoothly without interference with the upper portion of the bracket 60 of the front fork 40 when it turns.

Further, as shown in FIG. 4 (e) corresponding to the cross-sectional view taken along lines A-A of FIG. 4 (d), the bottom surface is formed with a concave in respect to the center of the circle and reverse-round surface, and with the distance between the opposite ends in the traveling direction to be relatively short. Namely, by making the bottom surface to be concave, it is possible to improve the responsiveness of the front fork 40 when it turns.

Figure 5:
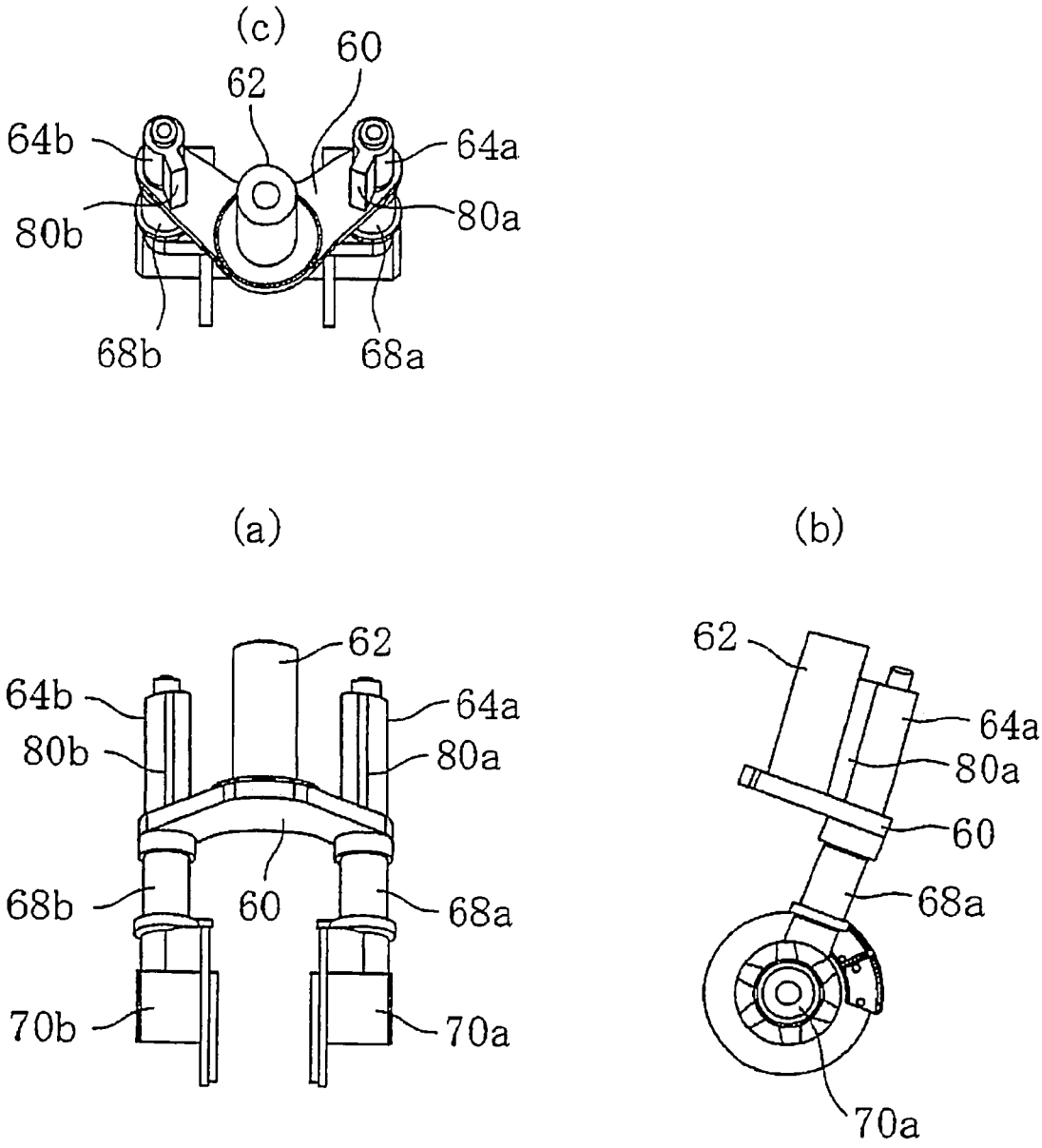
FIG. 5 is three side drawings illustrating the front of a front fork of the embodiment of the two-wheeled toy vehicle by radio control according to the present invention wherein (a) is a front elevation view, (b) is a side elevation view, (c) is a top view.

Next, as shown in FIG. 5 (b) illustrating the side elevation view, in the front fork 40 the shaft member 64 and the shaft member 68 are not aligned on the same axis line, and formed to bend over to the direction of traveling at the bracket 60 as a boundary. By utilizing this bending over it is possible to improve the responsiveness when the fork 40 turns.

Also, as shown in FIG. 5 (b), the shaft members 64*a* and 64*b* provides with stoppers 80*a* and 80*b*, respectively, which are projections protruding from the shaft members in the traveling direction with the same length as the radius of the shaft members. The stoppers 80*a* and 80*b* limit the front fork 40 so as not to turn more than a predetermined angle by contacting with the long cylindrical member 56 when the front fork 40 turns around the connecting pin 62.

The operation of the present invention is explained below.

At first, electric power is applied to the two-wheeled toy vehicle by radio control 1 utilizing the present invention. In accordance with a signal given from a transmitter for radio control (not shown), the servo unit controls the straight line traveling of the toy vehicle 1 so as to hold the position of the upper body 18 of the doll 16 in the center of the seat 10, thereby enabling the two-wheeled toy vehicle by radio control 1 to travel in the straight line without slanting or tilting to either direction.

Next, in case of turning the two-wheeled toy vehicle by radio control 1 to right, the servo unit, in response to a signal from the transmitter for radio control, operates to effect the parallel displacement so that the position of the upper body 18 of the doll 16 moves from the seat center to right, and the center of gravity of the doll 16 moves in accordance with such parallel displacement which is transferred through the chassis 34 to the front fork joint 38. Because the inside of the front fork joint 38 is formed with its upper portion to be oval and its bottom to be perfect circle, the end of the under surface opening portion 78 acts to push the connecting pin 62 and to slant the front fork 40. This tilting of the front fork 40 causes the tire 72 to slant to the direction of right by transferring the displacement of the center of gravity of the doll 16 at the opposite ends of the bracket 60 from the shaft members 68*a* and 68*b* to the wheel 30. Then, the rudder angle arises from the slanting of the tire 72, and as the result turning force is generated which enables the toy vehicle 1 to start a turning travel to right.

At this point, in case of the two-wheeled toy vehicle by radio control 1 according to the present invention, the slanting arises easily from the space to the connecting pin 62 in the upper surface opening portion 58 of the oval. Further, the slanting arises easily due to the bottom shape of the long cylindrical member 56. In addition, the shaft member 64 and the shaft member 68 are not aligned on the same axis line, and formed to bend over in the direction of traveling at the bracket 60 as a boundary, and then the slanting arises easily from such a bending over configuration.

In case of turning the two-wheeled toy vehicle by radio control 1 to left, the servo unit, in response to a signal from the transmitter for radio control, operates to effect the parallel displacement so that the position of the upper body 18 of the doll 16 moves from the seat center to left, and the center of gravity of the doll 16 moves in accordance with such parallel displacement which is transferred through the chassis 34 to the front fork joint 38. Because the inside of the front fork joint 38 is formed with its upper portion to be oval and its bottom to be perfect circle, the end of the under surface opening portion 78 acts to push the connecting pin 62 and to slant the front fork 40. This tilting of the front fork 40 causes the tire 72 to slant to the direction of left by transferring the displacement of the center of gravity of the doll 16 at the opposite ends of the bracket 60 from the shaft members 68*a* and 68*b* to the wheel 30. Then, the rudder angle arises from the slanting of the tire 72, and as the result turning force is generated which enables the toy vehicle 1 to start a turning travel to left.

In addition, when the front fork 40 turns more than a defined angle in the turning operation, it can not get back to the state of straight line travel. However, because the shaft members 64*a* and 64*b* constituting the front fork 40 provides with stoppers 80*a* and 80*b* which are projections protruding from the shaft members in the traveling direction with the same length as the radius of the shaft members, the stoppers 80*a* and 80*b* can limit turning of the front fork 40 so as not to turn more than a predetermined angle.

According to the present invention as mentioned above, the supporting member of the front wheel comprises a front fork joint 38 provided with a connecting portion 48 combined to the vehicle body and a long cylindrical member 56 having an oval shaped opening portion 58 at its upper part wherein the opposite ends are jointed with a specific angle to the connecting portion and the horizontal direction corresponds to a major axis, and a front fork 40 provided with a connecting pin 62 inserted into the opening portion 58 and fixed there so as to rotate and swing, a bracket 60 from the upper portion of which the connecting pin 62 protrudes upwardly and two shaft members 68 disposed underneath the bracket holding the tire 72 between the two shaft members 68.

Accordingly, it is possible to allow the two-wheeled toy vehicle to perform cornering operation and traveling in the straight line smoothly and stably, making the doll to act bodily motion closer to the actual rider.

In addition, the present invention is not limited to the configuration of the embodiment, but includes a modification and an improvement within the scope to achieve the object of the present invention. For instance, the internal shape of the long cylindrical member 56 with the vertical arrangement in the above embodiment could be changed to a cone-shaped hollow with an internal taper surface, thereby enhancing rigidity. Also, increase of taper portion in the cross-sectional shape of the tire 72 enhances sharpness of cornering operation.

Further, though in the above embodiment the front fork joint 38 provides with a long cylindrical member 56 having an internal shape with an oval-like opening portion 58 and forming juncture at a specific angle with the vertical joint plate 48, this front fork joint 38 is not limited to the long cylindrical shape. All that's required is a tube-like member, and for example, a rectangular parallelepiped member can be used. Further, the opening portions of each surface at the upper and the under parts of the tube—like member are not necessary to be circle, and any cross-sectional shapes of rectangular, oval or ellipse can be used as long as diameter of the horizontal direction at the upper surface opening portion is larger than that at the under surface opening portion. Namely, any shapes in which the connecting pin 62 could tilt and rotate can be used.

What is claimed is:

1. A two-wheeled toy vehicle by radio control having a supporting member of a front wheel mounted on a vehicle body so as to control freely in steering angle and a rider-like doll mounted on an upper portion of the vehicle body so as to swing, the doll, responsive to the radio controlled steering operation, effecting parallel displacement vertically to traveling direction and horizontally to the vehicle body, the steering operation being effected by slanting the supporting member of the front wheel in accordance with displacement of the toy's gravity center caused by the parallel displacement of the doll, wherein the supporting member of the front wheel comprises a front fork joint provided with a connecting portion combined to the vehicle body and a tube provided with an opening portion at its upper part wherein opposite ends are jointed with a specific angle to the connecting portion, and the horizontal direction corresponds to a major axis, and a front fork provided with a connecting pin inserted into the opening portion of the tube and fixed there so as to rotate and swing, a bracket from the upper portion of which the connecting pin protrudes and two shaft members disposed underneath the bracket holding a tire between the two shaft members.

2. The two-wheeled toy vehicle by radio control according to claim 1, characterized in that a diameter of the opening portion at the bottom of the tube is smaller than that of the opening portion at the upper part of the tube.

3. The two-wheeled toy vehicle by radio control according to claim 1, characterized in that the opening portion is oval.

4. The two wheeled toy vehicle by radio control according to claim 3, characterized in that the tube is a long cylindrical member.

5. The two-wheeled toy vehicle by radio control according to claim 4, characterized in that the bottom of the long cylindrical member has a convex and round face in the major axis direction, and a concave and round face in the minor axis direction.

6. The two wheeled toy vehicle by radio control according to claim 1, characterized in that the opening portion at the bottom of the tube is a perfect circle.

7. The two-wheeled toy vehicle by radio control according to claim 6, characterized in that the bottom of the long cylindrical member has a convex and round face in the major axis direction, and a concave and round face in the minor axis direction.

8. The two wheeled toy vehicle by radio control according to claim 1, characterized in that the front fork comprises respective shaft members upstanding at the upper part surface of the bracket so as to fix a fork stopper jointed with a steering handle, and respective protrusion for latch protruding from the surface of each shaft member in the direction of traveling to latch the long cylindrical member.

9. The two-wheeled toy vehicle by radio control according to claim 1, characterized in that the front fork further comprises another shaft members protruding from the under part of the bracket wherein each shaft member is at a specific angle with the respective shaft member upstanding at the upper part surface of the bracket.

10. The two wheeled toy vehicle by radio control according to claim 2, characterized in that the opening portion is oval.

* * * * *